US006740203B2

(12) United States Patent
Zilker

(10) Patent No.: US 6,740,203 B2
(45) Date of Patent: May 25, 2004

(54) PAPERMAKER'S NIP THICKENER FABRIC

(75) Inventor: Gregory D. Zilker, Brush Prairie, WA (US)

(73) Assignee: Albany International Corp., Albany, NY (US)

( * ) Notice: Subject to any disclaimer, the term of this patent is extended or adjusted under 35 U.S.C. 154(b) by 0 days.

(21) Appl. No.: 10/077,637

(22) Filed: Feb. 15, 2002

(65) Prior Publication Data

US 2003/0157289 A1 Aug. 21, 2003

(51) Int. Cl.[7] ..... D21F 1/30; D03D 3/04

(52) U.S. Cl. ..... 162/306; 162/903; 139/425 A; 428/194

(58) Field of Search ..... 162/116, 117, 162/122, 205, 306, 348, 358.1, 358.2, 358.4, 900–904; 139/383 A, 383 AA, 425 A; 428/126, 192–194; 210/400, 401; 198/844.1, 845, 846, 847, 848; 427/284, 285; 442/218, 227

(56) References Cited

U.S. PATENT DOCUMENTS

| | | | | | |
|---|---|---|---|---|---|
| 3,523,867 | A | * | 8/1970 | MacBean | 162/348 |
| 4,106,980 | A | | 8/1978 | Seifert et al. | 162/330 |
| 4,452,284 | A | | 6/1984 | Eckstein et al. | 139/383 A |
| 4,676,369 | A | * | 6/1987 | Borel | 198/853 |
| 4,722,793 | A | | 2/1988 | Seifert et al. | 210/401 |
| 4,772,253 | A | * | 9/1988 | Koizumi et al. | 474/266 |
| 5,021,159 | A | | 6/1991 | Bliss et al. | 210/396 |
| 5,039,412 | A | | 8/1991 | Marsh | 210/401 |
| 5,245,939 | A | | 9/1993 | Rouhling | 112/441 |
| 5,382,327 | A | | 1/1995 | Seifert et al. | 162/317 |
| 5,384,014 | A | | 1/1995 | Bliss | 162/317 |
| 5,422,166 | A | * | 6/1995 | Fleischer | 428/193 |
| 5,558,926 | A | * | 9/1996 | Tate et al. | 428/193 |
| 5,731,059 | A | | 3/1998 | Smith et al. | 428/192 |
| 5,814,566 | A | * | 9/1998 | Schlueter et al. | 442/88 |
| 5,840,378 | A | * | 11/1998 | Nagura et al. | 428/57 |
| 6,000,532 | A | | 12/1999 | Eckhardt | 198/847 |
| 6,065,505 | A | | 5/2000 | Fickers | 139/383 AA |
| 6,152,187 | A | | 11/2000 | Lindblom | 139/11 |
| 6,503,602 | B1 | * | 1/2003 | Crosby | 428/193 |

FOREIGN PATENT DOCUMENTS

| | | |
|---|---|---|
| DE | 927 851 C | 5/1955 |
| JP | 11-021780 | 1/1999 |

OTHER PUBLICATIONS

International Preliminary Search Report issued by European Patent Office for corresponding international application PCT/US03/04298 mailed Jun. 23, 2003.

* cited by examiner

*Primary Examiner*—Steven P. Griffin
*Assistant Examiner*—Eric Hug
(74) *Attorney, Agent, or Firm*—Frommer Lawrence & Haug LLP; Ronald R. Santucci

(57) ABSTRACT

A papermaker's fabric for use on a pulp thickening device and the like, having a body with edge portions on which are located guides with transition points between the body, and edge portions being reinforced with a coating that extends from the edge portions over the transition points onto the body.

17 Claims, 4 Drawing Sheets

PAPERMAKER'S NIP THICKENER FABRIC

FIELD OF THE INVENTION

The present invention is directed towards a papermaker's fabric or wire, particularly one for use in a dual nip stock thickening device.

BACKGROUND OF THE INVENTION

In the papermaking industry, there is an apparatus which is used to thicken pulp and paper stock. Early on such devices were commonly referred to as deckers. These early devices involved the use of cylinder molds which included a porous cylinder mold rotating in a vat of liquid with a controlled input of slurry. Water would be drained off through the cylinder mold thus thickening the remaining slurry which would be drained off. An example of this type of device can be found in U.S. Pat. No. 4,106,980.

An improvement on the then conventional thickeners can be found in U.S. Pat. No. 4,722,793. This patent describes a device which avoids the use of a cylinder mold. It employs a single pair of smooth-surfaced rolls and a single fabric trained around those rolls so that it wraps substantially 180° of the surface of each roll. The pulp stock to be thickened is initially delivered to the inside of a fabric run approaching the top of one roll so that the pulp is trapped in a zone between the fabric and the roll and is made to travel around the roll with the fabric. Centrifugal force causes liquid to be expressed through the fabric from the pulp trapped between the fabric and the roll.

The resulting partially dewatered pulp then travels on a lower fabric run to the other roll, where it is similarly subjected to centrifugal force causing further expression of liquid through the fabric. After travelling around the surfaces of both rolls, the pulp is removed from the surface of the second roll.

In order to guide the fabric in a path perpendicular to the axes of the two rolls, the fabric was provided along one or both of its edges on its bottom surfaces with a strip of material or guide in the shape of a V-belt. This guide was intended to fit into a peripheral groove in each of the rolls.

This belt is made separate from the fabric and mechanically attached thereto. Due, however, to the high- speed operation of the device, difficulty was encountered in maintaining the guide on the fabric.

In an effort to improve on this arrangement, U.S. Pat. No. 5,039,412 teaches providing for stitching the V-belt guide to the fabric and providing a band of adhesive on the fabric in the area of the stitching. The application of the adhesive extends a short distance inward from the side of the fabric. Also, guides are provided on the outer edge of the fabric so that they are positioned on the outside of the rolls rather than in a groove or grooves in the rolls.

While this design may have improved upon earlier designs by reinforcing the edges and supporting the V-belt guides, it has been found that the fabric tends to fail where the adhesive ends. It appears that the edges (with the guides) bounce during operation. This results in flexing of the fabric which is concentrated at the transition of the edging to the body of the fabric. Such a failure typically results in the edging (with the guide) separating from the body of the fabric.

SUMMARY OF THE INVENTION

It is therefore a principle object of the invention to provide for a papermaker's fabric which is reinforced at the edges thereof in a manner that improves the fabrics life.

It is a further object of the invention to provide for such reinforcement in a manner that is readily implemented and cost effective.

A further object of the invention is to provide for such reinforcement on a fabric used on a papermaker's pulp thickening apparatus.

The present invention provides for such objects and advantages in the following manner. In situations where the papermaker's fabric is subject to stress on its edges, a reinforcing or protective coating is provided on one or both sides of the fabric. More particularly, oftentimes the stress is located at a predominant location on the fabric. For example, with the aforesaid fabric for a thickening device, stress would be located at the transition between the edge or edge portions and the body of the fabric and would typically run the length of the fabric parallel to the edge. The present invention envisions a reinforcing coating to extend beyond the transition of the edge and body. This additional amount of coating would vary in the extent to which it extends into the body. Also, it terminates in the form of a series of curves, circle segments, or other projections. This allows for the stress (or flexing at the transition) to be distributed over a greater area which reduces or minimizes the hinging or pivoting effect of the edge against the body of the fabric.

BRIEF DESCRIPTION OF THE DRAWINGS

Thus by the present invention, its objects and advantages will be realized the description of which should be taken in conjunction with the drawings, wherein.

DETAILED DESCRIPTION OF THE PREFERRED EMBODIMENTS

Figure 1:
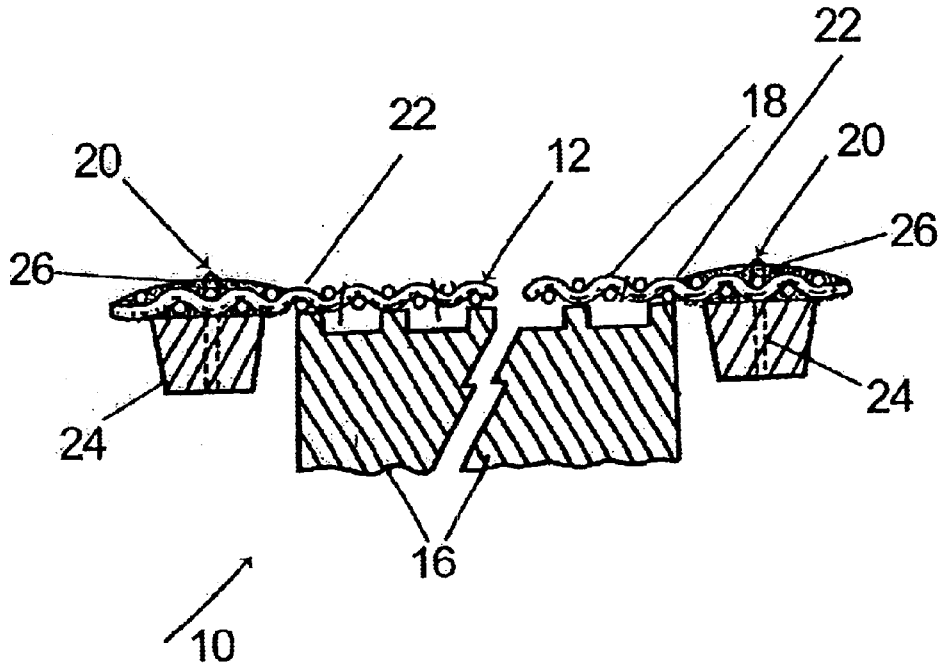
FIG. 1 PRIOR ART
FIG. 1 is a generally illustrative cross sectional view of a portion of a pulp thickening apparatus with a fabric thereon.

Turning now more particularly to the drawings, in FIG. 1 there is shown, for illustrative purposes, a portion of a pulp or stock thickener apparatus 10 with an endless woven fabric 12 thereon. This apparatus and fabric is that which is shown and described in U.S. Pat. No. 5,039,412, the disclosure of which is incorporated herein by reference. Note that the fabric 12 shown is believed to be that which is referred to in the industry as a (Thermo) Black Clawson Dual Nip Thickener Fabric. With the present invention in mind, the arrangement set forth in said patent will be briefly discussed, since the present invention is particularly suited in such an application.

A grooved roll 16 is typically one of two about which the fabric 12 travels. The fabric 12 can be a single or multiple layer design and is typically made of a plastic or polymeric material e.g. polyester. The fabric 12 includes a body portion 18 and edges or edge portions 20. There are respective transition points 22 between the body 18 and edge portions 20. Mechanically affixed to the underside or bottom surface of the edge portions 20 are respective V-belt guides 24. It is said that, in addition to stitching the guides 24 to the edge portions 20, the outer edges are impregnated with a urethane adhesive 26 over a band of about 1.5 inches wide. The guides 24 are intended to be on the outside of the roll 16.

Figure 2:
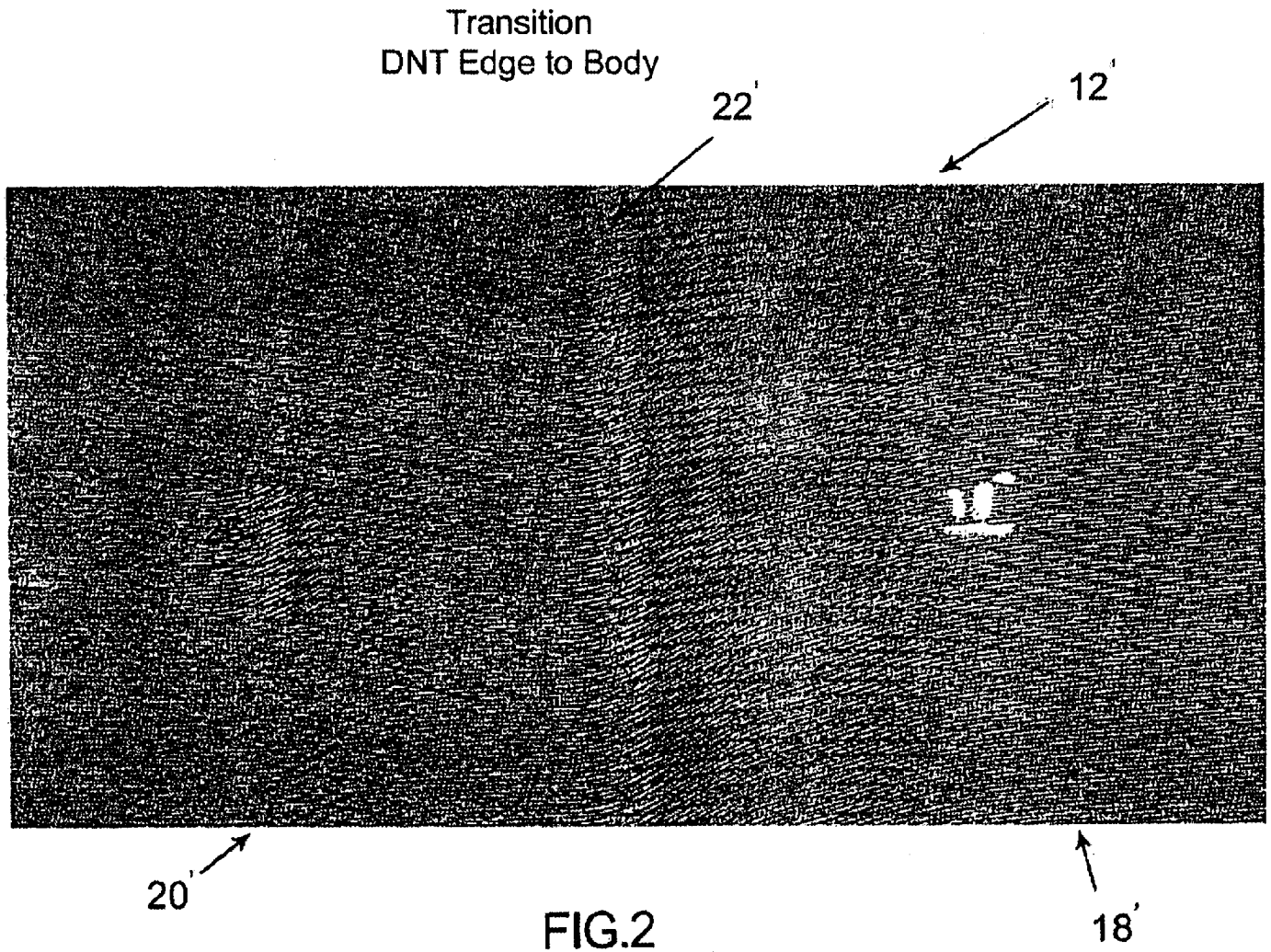
FIG. 2 is a top plan view of a portion of fabric showing the edge to body transition in a fabric.

FIG. 2 shows a fabric 12', a portion of the body 18' and an edge portion 20', with the transition point 22' located there between. In a typical application, the edge portion 20' would receive a coating 26' only up to the transition point 22'.

Figure 3:
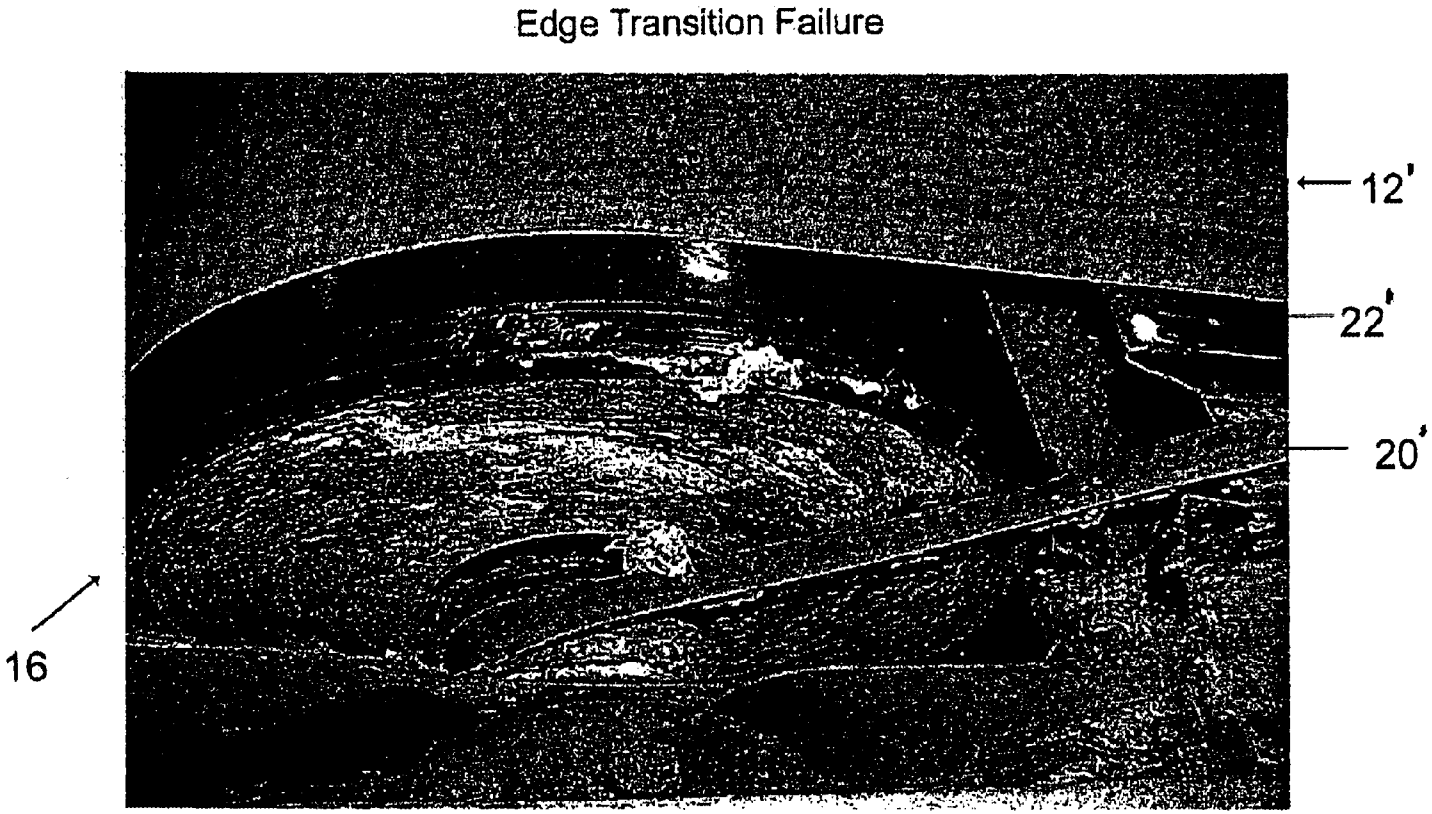
FIG. 3 PRIOR ART
FIG. 3 is a somewhat elevated side view of a fabric on a roll illustrating a failure along the edge to body transition.

In FIG. 3 there is illustrated the fabric 12' on a roll 16' with an edge portion 20' having separated from the body 18' at the transition point 22'which runs parallel to the end of the edge portion 20'. With such a failure, the machine would be shut down and the old fabric replaced with a new one. Obviously, this is detrimental to the production, so the longevity of the fabric is important.

Figure 4A:
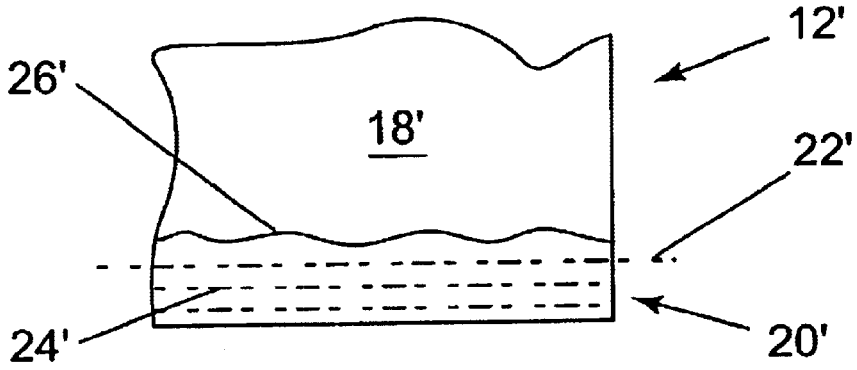
FIGS. 4A–4C are respective illustrative views of a portion of fabric having reinforcing or protective coating which extends beyond the edge to the body and is applied in various patterns, all of which incorporate the teachings of the present invention.
Figure 4B:
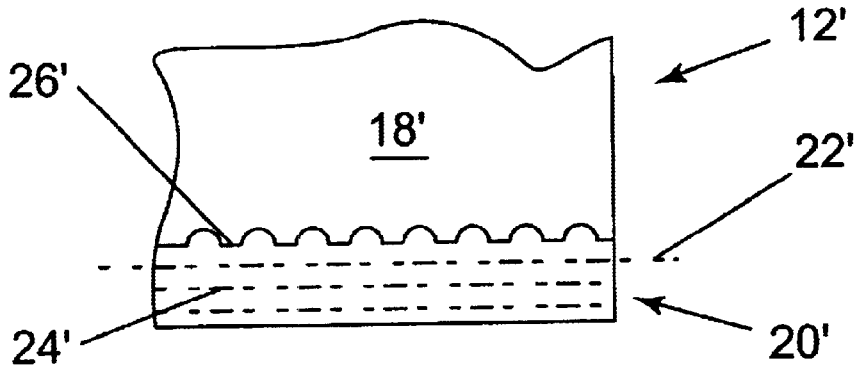
Figure 4C:
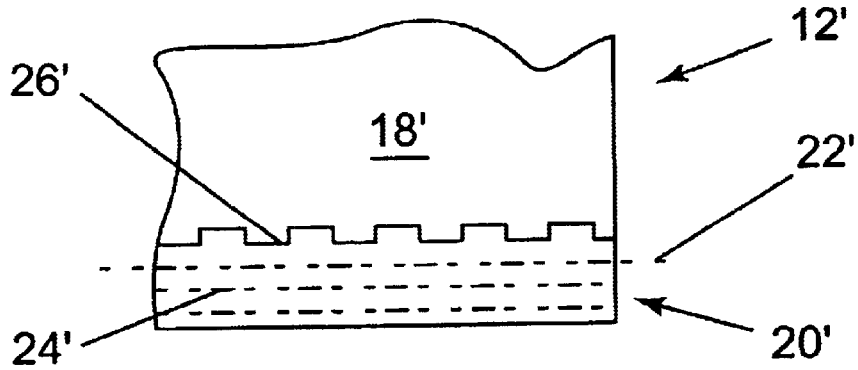

Turning now to FIGS. 4A–4C, there is shown a top surface of fabric 12' having a body portion 18' and edge portions 20'. Dash line 22' indicates the transition point there between. Lines 24' indicate the V-belt guide which may be affixed to the bottom surface of edge portion 20' by any means suitable for the purpose.

A protective or reinforcing coating 26' is provided on one or both surfaces (top and bottom) of the fabric 12' and on each of the edge portions 20'. The coating 26' may be polymeric or any other material suitable for the purpose. While being referred to as a coating, it actually impregnates the fabric and, among other things, locks the weave in place. As can be seen in FIGS. 4A–4C, the coating 26' extends beyond the transition point 22' and into a portion of the body 18' where it terminates in a series of curves (FIG. 4A), circle segments (FIG. 4B), or other projections (FIG. 4C) giving the coating 26' a scalloped finish. This type of arrangement would be along the entire edge portions 20' of the fabric 12'. Typically the edge portions 20' are about 2 inches wide. With this scalloped arrangement, the coating 26' covers, not only edge portions 20', but extends approximately 1.5–2.0 inches further into (cross machine direction) the body 18'. The coating 26' as aforesaid can be on opposite sides (top surface and bottom surface) of the fabric 12'. In addition, the pattern on one side need not be the same as that on the other side or even aligned therewith. For example, if a curved pattern is used, the top surface might have the curves in one position, with the bottom surface having its curves offset from that on the top surface. Accordingly, the curves on the bottom surface may be positioned in the valleys formed by the curves on the top surface and vice versa.

In any event, the purpose and effect of having the coating 26' extend into the body 18', whichever pattern is used, is to inhibit the flexing of the fabric at the transition point so as to minimize the hinging or pivoting of the edge portions against the body. By the present arrangement, the flexing at the transition point is distributed gradually over a greater area thereby extending the time period for fatigue to set in and the ultimate failure of the fabric.

It should be noted that the invention is particularly suited for a fabric of the type heretofore described which is used on a pulp thickener. However, it is envisioned that it has applications on other types of fabrics used in papermaking and other industries where force distribution at fracture zones is a necessary or desirable result.

Thus by the present invention its objects and advantages are realized, and although preferred embodiments have been disclosed and described in detail herein, its scope and objects should not be limited thereby; rather its scope should be determined by that of the appended claims.

What is claimed is:

1. A fabric for use in papermaking comprising:

a woven body having respective edge portions on opposite sides of the body;

said body and edge portions having a top surface and a bottom surface;

respective transition points which are subject to flexure between said respective edge portions and said body;

reinforcing coating on said either top or bottom surface; and said coating extending from at least one said edge portion in a non-linear pattern over said transition point and onto a portion of the body.

2. The fabric in accordance with claim 1, wherein said coating extends respectively from both said edge portions over said transition points and onto a portion of the body.

3. The fabric in accordance with claim 2, wherein said coating is located at said top surface and said bottom surface.

4. The fabric in accordance with claim 2, wherein said coating on said body is in a pattern which extends onto a portion of the body at varying distances from the transition point and terminates in the shape of curves, semi-circles or other projections.

5. The fabric in accordance with claim 3, wherein said coating on said body is in a pattern which extends onto a portion of the body at varying distances from the transition point and terminates in the shape of curves, semicircles or other projections.

6. The fabric in accordance with claim 3, wherein the pattern on the top surface is not aligned with the pattern on the bottom surface.

7. The fabric in accordance with claim 5, wherein the pattern on the top surface is not aligned with the pattern on the bottom surface.

8. The fabric in accordance with claim 1, wherein said coating is a polymeric material and serves to reinforce the fabric in an area on both sides of and across the transition point.

9. The fabric in accordance with claim 2, wherein said coating is a polymeric material and serves to reinforce the fabric in an area on both sides of and across the transition points.

10. The fabric in accordance with claim 3, wherein said coating is a polymeric material and serves to reinforce the fabric in an area on both sides of and across the transition points.

11. The fabric in accordance with claim 9 which includes respective guides affixed to the bottom surface of the edge portions.

12. The fabric in accordance with claim 11, wherein said fabric is in combination with a papermaker's pulp thickening device.

13. A fabric for use in papermaking comprising:

a woven body having respective edge portions on opposite sides of the body;

said body and edge portion having a top surface and a bottom surface;

respective transition points which are subject to flexure between said respective edge portions and said body;

reinforcing coating on said either said top or bottom surface; and said coating extends respectively from both said edge portion over said transition points and onto a portion of the body; and said coating on said body in a pattern which extends onto a portion of the body at varying distances from the transition point and terminates in the shape of curves, semi-circles and other projections.

14. The fabric in accordance with claim 13, wherein said coating is located at said top surface and said bottom surface.

15. A fabric for use in papermaking comprising:

a woven body having respective edge portions on opposite sides of the body;

said body and edge portions having a top surface and a bottom surface;

respective transition points which are subject to flexure between said respective edge portions and said body;

reinforcing coating on said top and bottom surfaces; and said coating extends from at least one said edge portion over said transition points and onto a portion of the body; and wherein said coating on said body is in a pattern which extends onto a portion of the body at varying distances from the transition point and terminates in the shape of curves, semi-circles or other projections.

16. The fabric in accordance with claim 14, wherein the pattern on the top surface is not aligned with the pattern on the bottom surface.

17. The fabric in accordance with claim 15, wherein the pattern on the top surface is not aligned with the pattern on the bottom surface.

* * * * *